US008256394B2

(12) United States Patent
Haas et al.

(10) Patent No.: US 8,256,394 B2
(45) Date of Patent: Sep. 4, 2012

(54) SWITCHABLE CUP TAPPET

(75) Inventors: Michael Haas, Hoechstadt (DE); Mario Kuhl, Herzogenaurach (DE); Norbert Nitz, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 370 days.

(21) Appl. No.: 12/527,572

(22) PCT Filed: Feb. 1, 2008

(86) PCT No.: PCT/EP2008/051243

§ 371 (c)(1),
(2), (4) Date: Oct. 7, 2009

(87) PCT Pub. No.: WO2008/101783

PCT Pub. Date: Aug. 28, 2008

(65) Prior Publication Data

US 2010/0050964 A1 Mar. 4, 2010

(30) Foreign Application Priority Data

Feb. 19, 2007 (DE) ..... 10 2007 008 573

(51) Int. Cl.
*F01L 1/14* (2006.01)

(52) U.S. Cl. ..... 123/90.48; 123/90.16

(58) Field of Classification Search .... 123/90.48–90.59, 123/90.16
See application file for complete search history.

(56) References Cited

U.S. PATENT DOCUMENTS

| | | | | |
|---|---|---|---|---|
| 5,431,133 | A | 7/1995 | Spath et al. | |
| 5,603,294 | A | 2/1997 | Kawai | |
| 5,651,335 | A * | 7/1997 | Elendt et al. | 123/90.16 |
| 5,782,216 | A * | 7/1998 | Haas et al. | 123/90.16 |
| 5,934,232 | A | 8/1999 | Greene et al. | |
| 5,950,583 | A * | 9/1999 | Kraxner et al. | 123/90.16 |
| 6,213,076 | B1 * | 4/2001 | Fischer et al. | 123/90.55 |
| 6,457,445 | B1 * | 10/2002 | Sugawara | 123/90.16 |
| 8,001,940 | B2 * | 8/2011 | Sailer et al. | 123/90.48 |

FOREIGN PATENT DOCUMENTS

| | | | |
|---|---|---|---|
| DE | 924545 | C | 3/1955 |
| DE | 3205878 | A1 | 9/1982 |
| DE | 3239325 | A1 | 4/1984 |
| DE | 3332455 | A1 | 4/1984 |
| DE | 8506244 | U1 | 10/1986 |
| DE | 42 06 166 | A | 9/1992 |

(Continued)

*Primary Examiner* — Thomas Denion
*Assistant Examiner* — Daniel Bernstein
(74) *Attorney, Agent, or Firm* — Lucas & Mercanti, LLP; Klaus P. Stoffel

(57) ABSTRACT

A switchable cup tappet for a valve timing mechanism of an internal combustion engine, which has a cup basic body with an annular base loaded by large-lift cams. A hollow-cylindrical projection protrudes from an inner edge of the base and an inner body extends in the hole of the projection. The disc-like base is contacted by a small-lift cam. In a hole of the inner body two coupler pistons are coupled in sections with a driver surface of the cup basic body for a large valve stroke. The small stroke occurs by complete displacement into the radial hole. An annular web, spaced from its end faces at both ends, is attached integrally, in which the radial hole extends with the coupler pistons. The driver surface for the pistons is formed by a lower edge of the projection, which is spaced from the bases.

19 Claims, 1 Drawing Sheet

FOREIGN PATENT DOCUMENTS

| | | | |
|---|---|---|---|
| DE | 42 10 567 | A | 10/1992 |
| DE | 9306685 | U1 | 6/1993 |
| DE | 4436952 | A1 | 4/1996 |
| DE | 196 52 677 | A | 6/1998 |
| DE | 44 92 633 | A | 5/2001 |
| DE | 60111117 | T2 | 5/2006 |
| DE | 102005030718 | A1 | 1/2007 |
| EP | 0874139 | A2 | 10/1998 |
| GB | 898599 | A | 6/1962 |
| JP | 63074308 | U | 5/1988 |

* cited by examiner

SWITCHABLE CUP TAPPET

This application is a 371 of PCT/EP2008/051243 filed Feb. 1, 2008, which in turn claims the priority of DE 10 2007 008 573.9 filed Feb. 19, 2009, the priority of both applications is hereby claimed and both applications are incorporated by reference herein.

FIELD OF THE INVENTION

The invention relates to a switchable bucket tappet for a valve drive of an internal combustion engine, having a bucket basic body which has a ring-like base and which can be guided, by means of its skirt which projects from the outer edge of the base, in a bore of the internal combustion engine, which base can be acted on by at least one high-lift cam, with a hollow cylindrical extension projecting from an inner edge of the base, in the bore of which extension runs an inner body which is axially movable relative to the bucket basic body and whose disk-like base can come into contact with a low-lift or zero-lift cam and whose underside has formed in it an abutment for at least indirect contact with the gas exchange valve, with at least one coupling piston running in a bore of the inner body, which coupling piston, in order to obtain a high valve lift, can be placed in engagement in sections with a driver surface of the bucket basic body, with a low valve lift or zero valve lift being obtained when said at least one coupling piston is fully retracted into the bore, and with a lost motion spring acting between the bucket basic body and inner body.

BACKGROUND OF THE INVENTION

A bucket tappet of said type can be gathered from DE 44 92 633 C1, which is regarded as being generic. The coupling mechanism of the bucket tappet is arranged directly below the base. A person skilled in the art will recognize that the already known tappet is of relatively complex design, and the production thereof has therefore proven to be unnecessarily expensive. For example, the outer part is of asymmetrical design in the base region, since guide bores for the coupling piston are formed directly below the annular base. It can also be seen that the inner part is of unnecessarily massive design, in particular in the base region. Said massive design is associated with an undesired increase in the oscillating valve drive masses. Furthermore, on account of the piston-in-bore coupling, a relatively high component loading can occur in the coupling section, and anti-twist measures are necessary between the bucket basic body and the inner body.

Object of the Invention

It is therefore an object of the invention to create a bucket tappet of the above-mentioned type in which the stated disadvantages are eliminated by simple means.

Achievement of the Object

According to the invention, said object is achieved in that the inner body, at least proceeding from one end surface, is of substantially thin-walled, tubular design, with an annular web being integrally connected at a distance from the end surfaces at both ends of said inner body, in which annular web runs the bore, such as a radial bore, with the at least one coupling piston, with the driver surface for the coupling piston being formed by a lower edge, which is spaced apart from the bases, of the hollow cylindrical extension, and with a region of the base of the bucket basic body being of virtually symmetrical and continuously thin-walled design.

The stated disadvantages are hereby eliminated. As a result of the at least substantially symmetrical design of the bucket basic body, the production of the latter is simplified and made cheaper, and its mass is reduced. The inner body, which is also of very simple design and which should advantageously be of thin-walled tubular design at least one side, can be formed in a particularly simple manner in terms of production, for example by extrusion, with it if appropriate also being possible for said inner body to be of massive design or formed by primary forming. Said inner body likewise has only a relatively low mass. If appropriate, said inner body may also be composed of two simple separate tubular or cylindrical sections, which then form a structural unit together with the likewise separate annular web.

Also encompassed by the scope of protection of this invention is a solution in which the inner body, for example proceeding from its base-side face or else from its opposite face [or from both faces] is of massive design at least in sections. If appropriate, the cam run-on base may then be formed in one piece with the massive upper section.

By means of the coupling, which is also proposed, of the at least one coupling piston under the edge of the hollow cylindrical extension, it is possible (but not imperative) to preferably dispense with measures to prevent twisting of the two tappet components with respect to one another. For coupling, therefore, use is made of an already existing region of the bucket basic body (hollow cylindrical extension).

Relatively low-load coupling is provided in particular when the coupling piston(s) is/are pushed with a flattened upper side under the edge of the extension in the coupled state. If appropriate, however, other coupling structures, if appropriate also with anti-twist measures, are conceivable and provided in said engagement region.

It is particularly expedient, if the base of the inner body is provided as a separate component. If appropriate, the base may be provided, before assembly, with suitable wear-prevention measures such as applied layers/heat treatment. As connecting processes for connecting the separate, disk-shaped base to the inner body, consideration is given for example to joining, welding, soldering, adhesive bonding, a snap-action connection, etc. Here, to fix the separate base to the inner body, the latter may have a stump-like extension whose edge runs firmly against an inner casing of the inner body. Alternatively, provision is made for the base to be formed in one piece with the inner body.

According to a further expedient refinement of the invention, provision is made for the coupling piston(s) to be moved in the coupling direction by means of a hydraulic medium. As proposed in one physical embodiment of the invention, the hydraulic medium may be conducted, proceeding from a radial bore in the skirt, through ducts which are formed in a separate, thin-walled element such as a sheet-metal part which is placed in the interior of the bucket basic body.

A movement of the coupling piston(s) radially inward into the decoupled position in the bore may be realized, for example by means of the force of at least one flexible spring, such as a metal flexible spring, which encompasses the outer face(s) of said coupling piston(s) in the manner of a belt. The flexible spring has, for example, a leaf-spring-like or tongue-like geometry and may simultaneously serve as an anti-twist device for the coupling piston(s), such that it is possible to dispense with separate anti-twist measures for this purpose.

As an alternative to the above measure, it is proposed that the coupling piston(s) be moved radially inward into the decoupled position by means of the force of a tension spring.

If use is made of two coupling pistons which are arranged so as to be situated diametrically opposite, wherein the invention may expressly also be realized using only one coupling piston or using more than two coupling pistons, secure coupling with a relatively low contact pressure is provided in the coupled state. As a bore for the coupling piston(s), use may, for example, be made of a radial bore, a blind bore or else a bore which runs in the manner of a secant or in an oblique fashion.

Likewise encompassed by the subject matter of the application are simple measures for setting a coupling or locking play. Accordingly, it is proposed that, for example, a pack of securing rings be attached to a cylindrical section, which runs above the annular web, of the inner body; one of which rings (for example the upper ring) may be provided in a range of different thicknesses in a manner known per se during assembly. A region of the inner edge of the base of the bucket basic body may then abut against an underside of said ring pack.

Alternatively, a coupling play may also be set by means of only one securing ring which may be provided in a range of different thicknesses, in a manner known per se. Said design may also simultaneously serve generally to provide travel limitation and captive retention. It is also possible instead of the one or two securing rings to provide other components, such as pins, balls or the like, which act radially between the elements.

To create a smooth abutment for one end of the required lost motion spring, an annular part is provided on the radial passages on an underside of the thin-walled element in the region of the base.

The bucket tappet according to the application may be designed such that a hydraulic play compensating device of known design can be or is installed in a lower cylindrical section of the inner body of said bucket tappet. Mechanical play adjusting measures are also conceivable and provided if appropriate.

Further subclaims relate to simple measures for limiting the travel of the coupling piston(s) in the outward direction. Here, the respective coupling piston may abut with its radially outer end side, for example, against a section of the thin-walled element at the outer casing of the hollow cylindrical extension, which section runs axially beyond the edge of the hollow cylindrical extension (in the coupled state or when running through the cam base circle). Alternatively, the travel of the respective coupling piston, if the latter is of stepped design, may be limited, in the coupled state, by the bore of the hollow cylindrical extension in interaction with the radially recessed step region of said coupling piston.

On account of the cylindrically arched profile of at least one of the bases of the bucket tappet [anti-twist measures are then necessary] proposed in one refinement of the invention, the bucket tappet can be of relatively narrow design.

BRIEF DESCRIPTION OF THE DRAWINGS

The invention is expediently explained in more detail on the basis of the drawing, in which.

DETAILED DESCRIPTION OF THE DRAWINGS

The Figures illustrate a switchable bucket tappet 1 for a valve drive of an internal combustion engine. Said bucket tappet 1 can advantageously be switched to different cam contours.

Figure 2:
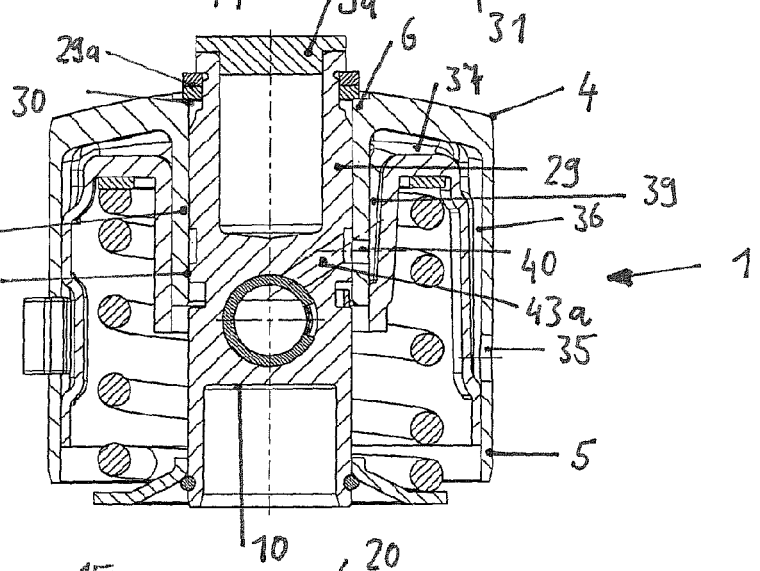
FIG. 2 shows a sectioned view, rotated by 90°, according to FIG. 1.

The bucket tappet 1 is composed of a bucket basic body 3, which is closed off at the cam side by a ring-shaped base 2, which, as shown in more detail in FIG. 2, is of cylindrical design in the cam excursion direction. The base 2 makes contact, in a manner known per se, with two spaced-apart high-lift cams in the assembled state. A hollow cylindrical skirt 5 projects from an outer edge 4 of the base 2. By means of an outer casing of said skirt 5, the bucket tappet 1 can be arranged in an oscillating fashion in a receptacle (not illustrated in the drawing) of the internal combustion engine.

A hollow cylindrical extension 7 projects from an inner edge 6 of the base 2. Said extension 7 has a bore 8 in which runs an inner body 9 as a further essential constituent part of the bucket tappet 1. The inner body 9 is designed so as to be axially movable relative to the bucket basic body 3. The inner body 9 acts with an underside 10 at least indirectly on one or more gas exchange valves in a lifting sense. If appropriate, a hydraulic play compensating element may also be installed in the lower cylindrical section 45 of said inner body 9.

The bore 8 of the extension 7 of the bucket basic body 3 therefore serves as a guide for an outer side 42 of the inner body 9 which is composed, in addition to the lower cylindrical section 45, of an upper cylindrical section 29. An annular web 17 having a radial bore 11 is arranged between the two sections 45, 29. It can be seen that the inner body 9 therefore has, overall, the form of a tube.

The upper cylindrical section 29 of the inner body 9 is delimited by a separate, disk-shaped base **9*a* for making contact with a low-lift cam. The base 9*a* has a stump-like extension 20, by means of the edge 21 of which said base 9*a* runs firmly against an inner casing 22 of the upper cylindrical section 29**.

For coupling, two diametrically oppositely situated coupling pistons 12 run in the above-mentioned radial bore 11. Said coupling pistons 12 have, proceeding from their radially inner faces 23, in each case, one flattened portion 24 on their upper sides. In the coupled state, illustrated in FIG. 1, the coupling pistons 12 run with their portions 24 under an edge 18 (driver surface 13) of the hollow cylindrical extension 7 of the bucket basic body 3. Said coupling pistons 12 can be moved in the coupling direction by means of hydraulic medium (see below). A movement in the decoupling direction is produced by means of the force of a flexible spring 27, preferably composed of metal, which encompasses the outer faces 23 of said coupling pistons 12 in the manner of a belt.

Hydraulic medium is conducted from an aperture 35 in the skirt 5 into a pressure chamber 25 radially at the inside in front of inner faces 26 of the coupling pistons 12. As can be seen, a thin-walled element 32 is placed in the interior 31 of the bucket tappet 1, which thin-walled element 32 substantially follows the inner contour of said bucket tappet 1. A rising duct 36 is formed into the element 32 in the skirt region proceeding from the aperture 35. At the base side, the element 32 has at least one radial passage 37, (preferably a plurality of radial passages 37 distributed in a stellate fashion) which is connected radially at the inside to at least one axial duct 39 which runs between the outer casing 33 of the extension 7 and the element 32.

To conduct the hydraulic medium, the hollow cylindrical extension 7 has, in its lower region, an opening 40 which is fed by the axial duct 39. The opening 40 in turn communicates with an annular groove 41 on the outer side 42 of the inner body 9. From the annular groove 41, the hydraulic medium is conducted onward through a duct **43*a* into the pressure chamber 25. Instead of said annular groove 41 on the inner body 9, it is also possible for the hollow cylindrical extension 7 to be provided with a corresponding annular groove, such that the duct 43***a* can open out "smoothly" at the outer side 42 of the inner body 9.

Figure 1:
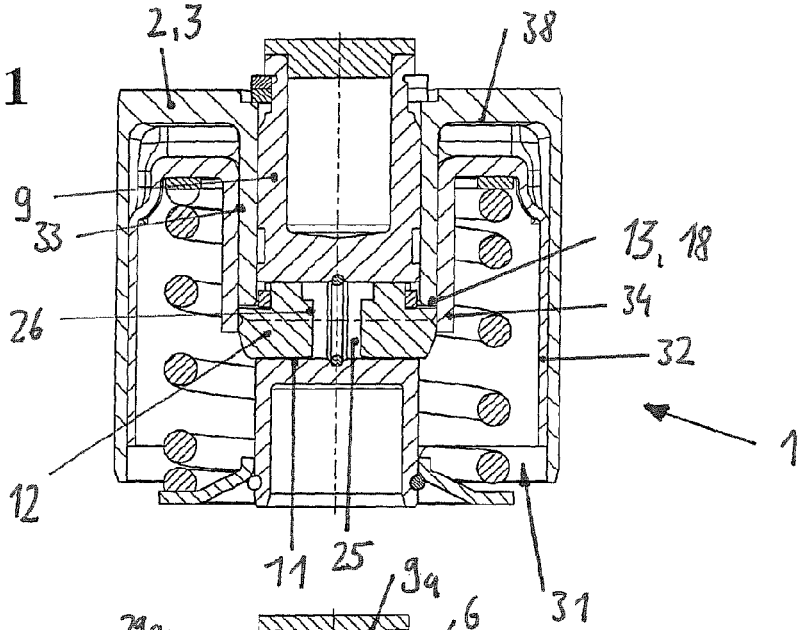
FIG. 1 shows a longitudinal section through a switchable bucket tappet with the coupling pistons deployed.
Figure 3:
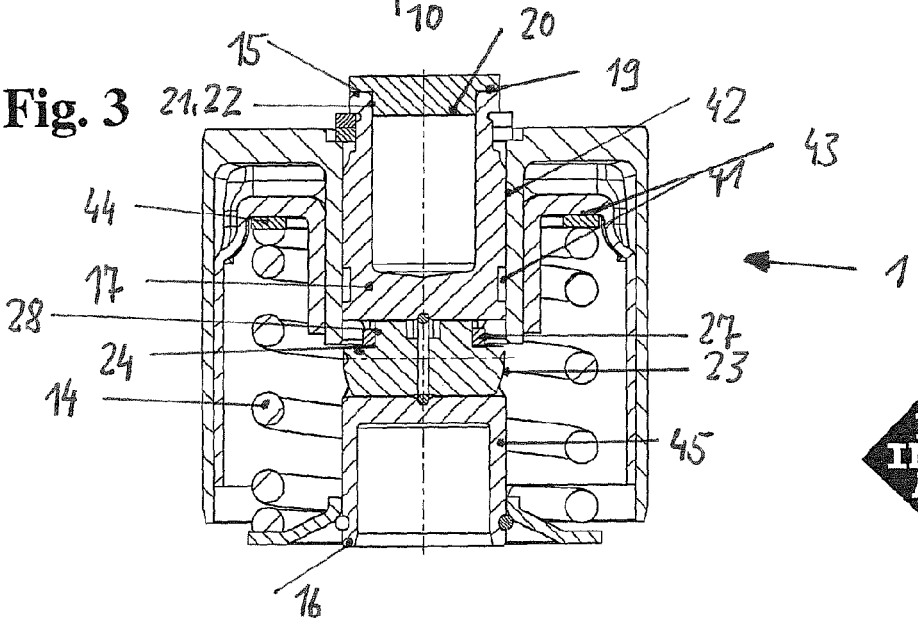
FIG. 3 shows a section similar to that in FIG. 1, but with the coupling pistons radially retracted.

According to FIG. 1, the coupling pistons 12 abut with their outer faces 23 against an axially downwardly elongated section 34 of the element 32. Alternatively, the travel of the coupling pistons 12 may also, as illustrated in FIG. 3, be limited at least indirectly by a lower end region of the hollow cylindrical extension 7 in interaction with the step regions 28 of said coupling pistons 12.

It can also be seen from the Figures that two securing rings, which are situated one above the other, are attached, as a height stop element 29*a*, to the upper cylindrical section 29 of the inner body 9. When running through the cam base circle, a region of the inner edge 6 of the base 2 of the bucket basic body 3 abuts against the underside 30 of said height stop element 29*a*.

LIST OF REFERENCE SYMBOLS

1 Bucket tappet
2 Ring-like base
3 Bucket basic body
4 Outer edge
5 Skirt
6 Inner edge
7 Hollow cylindrical extension
8 Bore, extension
9 Inner body
9*a* Disk-shaped base
10 Underside
11 Bore, radial bore
12 Coupling piston
13 Driver surface
14 Lost motion spring
15 End face, inner body
16 End face, inner body
17 Annular web
18 Edge
19 Underside
20 Extension
21 Edge
22 Inner casing
23 Outer face
24 Portion
25 Pressure chamber
26 Inner face
27 Flexible metal spring
28 Step region
29 Cylindrical section
29*a* Height stop element
30 Underside
31 Interior
32 Element
33 Outer casing
34 Portion
35 Aperture
36 Rising duct
37 Radial passage
38 Underside
39 Axial duct
40 Opening
41 Annular groove
42 Outer side
43 Underside
43*a* Duct
44 Annular part
45 Cylindrical section

The invention claimed is:

1. A switchable bucket tappet for a valve drive of an internal combustion engine, comprising:

a bucket basic body having a ring-like base and being guided by means of a skirt, which projects from an outer edge of the ring-like base, in a bore of the internal combustion engine, the ring-like base being acted on by at least one high-lift cam, a hollow cylindrical extension projecting from an inner edge of the ring-like base, in the bore of the hollow cylindrical extension runs an inner body which is axially movable relative to the bucket basic body and whose disk-like base comes into contact with a low-lift or zero-lift cam and whose underside has formed in it an abutment for at least indirect contact with a gas exchange valve, with at least one coupling piston running in a bore of the inner body, the at least one coupling piston, in order to obtain a high valve lift, is placed in engagement in sections with a driver surface of the bucket basic body, with a low valve lift or zero valve lift being obtained when the at least one coupling piston is fully retracted into the bore of the at least one coupling piston, and with a lost motion spring acting between the bucket basic body and the inner body, wherein the inner body, at least proceeding from one end surface, is of substantially thin-walled, tubular design having upper and lower hollow cylindrical sections separated from one another by a solid, one-piece section, with said solid section being integrally connected to said upper and lower hollow cylindrical sections at a distance from the end surface at both ends of the inner body, in which the solid section runs the bore of the at least one coupling piston, with the at least one coupling piston, with the driver surface for the at least one coupling piston being formed by a lower edge, which is spaced apart from the ring-like base and the disk-like base of the hollow cylindrical extension, and with a region of the ring-like base of the bucket basic body being of virtually symmetrical and continuously thin-walled design.

2. The bucket tappet of claim 1, wherein the disk-like base of the inner body is a separate component.

3. The bucket tappet of claim 2, wherein a stump-like extension extends from an underside of the disk-like base of the inner body, and an edge of the extension runs against an inner casing of the inner body.

4. The bucket tappet of claim 1, wherein the at least one coupling piston is provided, proceeding from a radially outer face, with a flattened portion on its upper side, by means of the flattened portion of the at least one coupling piston is, in a coupled state, moved under the edge of the hollow cylindrical extension of the bucket basic body.

5. The bucket tappet of claim 4, wherein the at least one coupling piston is moved in a coupling direction by means of a hydraulic medium which is conducted into a pressure chamber, which is formed in the bore, in front of a radially inner face of the at least one coupling piston, with movement of the at least one coupling piston in a decoupling direction being affected by means of a force of at least one flexible spring which encompasses the outer face of the at least one coupling piston in a manner of a belt, or by means of the force of at least one helical tension spring, which is fastened to the inner face of the at least one coupling piston.

6. The bucket tappet of claim 5, wherein the flexible spring acts directly on a radially recessed step region of the at least one coupling piston, the step region being situated radially to an inside after the flattened portion.

7. The bucket tappet as of claim 5, wherein the flexible spring is an anti-twist device for the at least one coupling piston.

8. The bucket tappet of claim 5, wherein, as the flexible spring composed of metal, use is made of a slotted ring.

9. The bucket tappet of claim 1, wherein the inner body is rotationally movable relative to the bucket basic body.

10. The bucket tappet of claim 1, wherein an anti-twist device is formed between the inner body and bucket basic body.

11. The bucket tappet of claim 1, wherein one or two securing rings situated one above the other are provided as a height stop element on a cylindrical section, which runs above the solid section of the inner body, against an underside of the height stop element abutting a region of an inner edge of the ring-like base of the bucket basic body, wherein when one securing ring is used, the one securing ring is provided in a range of different thicknesses to set a coupling play, or when two securing rings are used, at least one is provided in a range of different thicknesses to set the coupling play.

12. The bucket tappet of claim 5, wherein a thin-walled element is placed in an interior of the bucket basic body and substantially follows an inner contour of the bucket basic body.

13. The bucket tappet of claim 12, wherein the element, at an outer casing of the hollow cylindrical extension, runs axially with a section beyond the edge as the driver surface of the hollow cylindrical extension, and in that travel of the at least one coupling piston, in the coupled state, is limited by the section in interaction with the radially outer face of the at least one coupling piston.

14. The bucket tappet of claim 4, wherein travel of the at least one coupling piston, in the coupled state, is limited by the bore of the hollow cylindrical extension in interaction, at least indirectly, with a radially recessed step region of the at least one coupling piston, the step region being situated radially to an inside after the flattened portion of the at least one coupling piston.

15. The bucket tappet of claim 12, wherein at least one rising duct for the hydraulic medium is formed, proceeding from at least one aperture in the skirt, between the aperture and the element, the rising duct being connected to at least one tubular radial passage between an underside of the ring-like base and the element, with the at least one radial passage being connected radially at an inside to at least one axial duct which, between an outer casing of the hollow cylindrical extension and the element, is guided in a direction away from the base, with an opening which is connected in a fluid manner to a lower end of the axial duct running in the hollow cylindrical extension, the opening communicating radially at the inside with an annular groove at an outer side of the inner body, proceeding from the annular groove a duct for the hydraulic medium leads through the solid section into the pressure chamber.

16. The bucket tappet of claim 15, wherein the at least one radial passage in the base is distributed about a circumference in a stellate fashion, and is formed as a duct-like molded portion, which points away from the base, in the element, with an annular part as an abutment for one end of the lost motion spring running on an underside of the at least one radial passage.

17. The bucket tappet of claim 1, wherein a hydraulic play compensating element is installed in a cylindrical section, which runs below the solid section of the inner body.

18. The bucket tappet of claim 1, wherein precisely two coupling pistons are situated diametrically opposite in the bore of the inner body, or a plurality of bores run in the inner body so as to be distributed in a stellate fashion over a circumference, and in the bores are seated at least, in each case, one coupling piston.

19. The bucket tappet of claim 1, wherein at least one of the ring-like base or the disk-like base of the bucket tappet has a cylindrically arched profile in a cam excursion direction.

* * * * *